US005094199A

United States Patent [19]

Griffin

[11] Patent Number: 5,094,199

[45] Date of Patent: Mar. 10, 1992

[54] IGNITION CONTROLLED STARTING MOTOR INTERLOCK CIRCUIT

[75] Inventor: Adam H. Griffin, 293 Durian St., Vista, Calif. 92083

[73] Assignee: A. H. Griffin, Vista, Calif.

[21] Appl. No.: 563,284

[22] Filed: Aug. 6, 1990

[51] Int. Cl.[5] ..... F02N 11/10

[52] U.S. Cl. ..... 123/179.1; 290/38 R

[58] Field of Search ..... 123/179 BG, 179 B, 179 R, 123/179 A; 290/38 R, 38 C

[56] References Cited

U.S. PATENT DOCUMENTS

| | | | |
|---|---|---|---|
| 3,053,243 | 9/1962 | Domann | 123/179 B |
| 3,530,846 | 9/1970 | Bean et al. | 123/179 BG |
| 3,712,283 | 1/1973 | Kiess et al. | 123/179 B |
| 4,070,585 | 1/1978 | Parkyn | 290/38 R |
| 4,104,534 | 8/1978 | Hill et al. | 123/179 BG |
| 4,549,089 | 10/1985 | Buetemeister et al. | 290/38 R |

FOREIGN PATENT DOCUMENTS

| | | | |
|---|---|---|---|
| 54-52236 | 4/1979 | Japan | 290/38 R |
| 56-9654 | 1/1981 | Japan | 290/38 R |

*Primary Examiner*—Andrew M. Dolinar
*Attorney, Agent, or Firm*—Snum-In-Um

[57] ABSTRACT

Apparatus for causing a starting motor interlock switch to be activated when the vehicle engine ignition is running, the vehicle having an electrical battery associated with the engine, and the running of the engine causing impulse signals to appear at an inductively coupled sensing element. The apparatus has an electrical circuit which converts the incoming impulses to a DC signal indicating an engine running condition. The invention senses when the ignition circuit of an engine has operated in excess of a predetermined time interval. Having sensed such operation, the unit latches into a position which open-circuits a relay (interlock) thereby causing the starting motor system of the vehicle to become disabled. When the ignition source shuts off, the unit latches into a position which re-enables the starting motor circuit after a predetermined time interval.

5 Claims, 1 Drawing Sheet

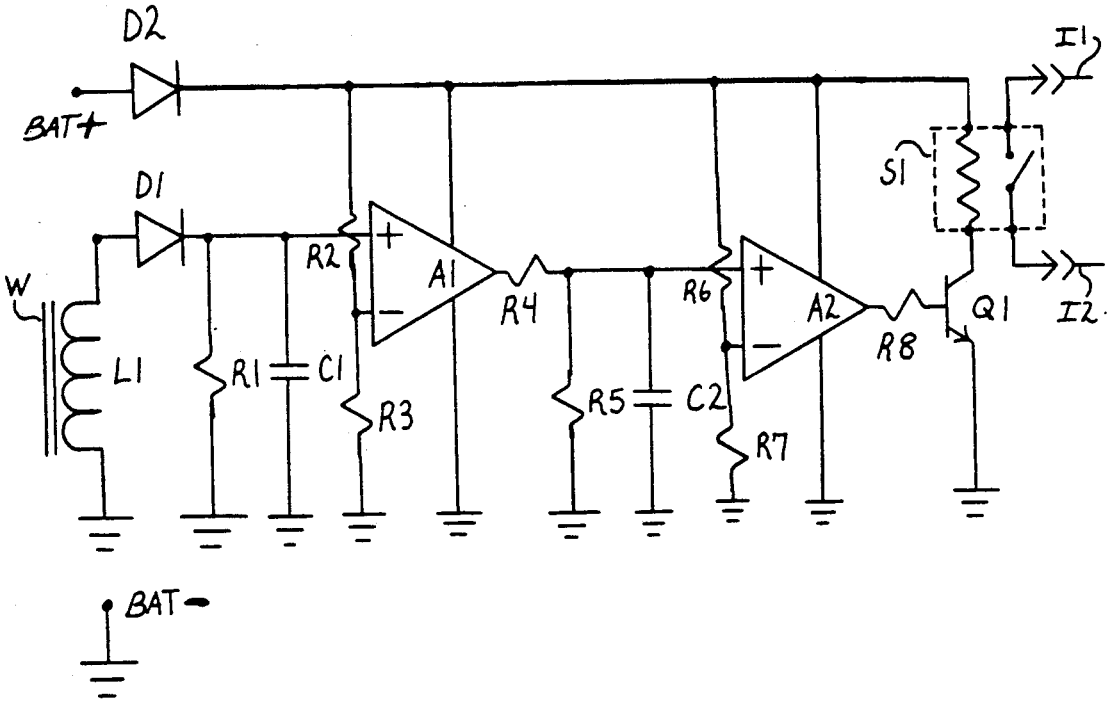
D2
BAT+
D1
W
L1
R1
C1
R2
R3
A1
R4
R5
C2
R6
R7
A2
R8
Q1
S1
I1
I2
BAT-

IGNITION CONTROLLED STARTING MOTOR INTERLOCK CIRCUIT

BACKGROUND OF THE INVENTION

This invention relates to apparatus for causing the starting motor of a vehicle to become disabled when the veicle engine is running.

Examples of prior art starter motor lock out systems can be found in U.S. Pat. No. 4,549,089 to Buetemeister et al., U.S. Pat. No. 4,070,585 to Parkyn and U.S. Pat. No. 4,104,534 to Hill et al. These prior art circuits suffer from two disadvantages:

1. The electronic circuitry is rather complex.
2. The circuits cannot be easily installed on a vehicle as a retrofit device.

Unlike the prior art, my invention allows for simple installation by using a magnetic sensor inductively coupled to the secondary coil wire.

SUMMARY OF THE INVENTION

The object of the invention is to provide a starting motor interlock for motor vehicles which is relatively simple for a vehicle owner and manufacturer to install. Due to its timing delay mechanisms the invention serves twofold purpose: (i) The invention is intended to protect an automobile starting motor from operating when the engine is already running, which prevents consequential damage to the vehicle flywheel and starting motor, (ii) when a vehicle will not start due to non-ignition related condition, the invention will prevent continuous operation of the starting motor by opening the interlock contacts after a predetermined time.

The present invention is based on the realization that effective starting motor interlock actuating signal can be effected by utilization of impulse signals inductively coupled from the ignition coil wire.

According to the invention, automatic starting motor interlock comprises an electrical circuit including means for converting inductively coupled impulse signals from the secondary coil of the ignition system of the vehicle when the engine ignition is running to a DC signal indicating an engine running condition.

The apparatus includes time delay means to delay provision of the actuating signal for a predtermined time after the vehicle ignition circuit has started operating. The apparatus includes time delay means to maintain the provision of the actuating signal for predetermined time after the vehicle ignition has stopped operating.

The external starting motor system actuated may be comprised of control circuitry or a control solenoid switch.

BRIEF DESCRIPTION OF THE DRAWING

The single FIGURE shows a circuit diagram of an ignition controlled starting motor interlock circuit according to the invention.

DETAILED DESCRIPTION OF THE INVENTION

The process by which the preferred circuit embodiment is composed consists of a patterned, metal cladded circuit board made of fiberglass or other similar material, with resistors, capacitors, semiconductors, connectors and other components attached to the circuitboard. The principle mode of operation of this device involves sensing the presence of electrical impulse signals and open circuiting a relay after a perdetermined time.

Referring to the drawing, interconnects I1 and I2 are inserted in series with the external starting motor control line. The vehicle battery is connected to the BAT+ and BAT− terminals providing circuit power. Diode D2 serves to protect the circuit from inadvertant negative input voltage at the input terminal BAT+. Cylindrical ferrite core L1 and its windings constitute a sensor. The ferrite cylinder is placed around the vehicle secondary coil wire W. Consequently, the electrical current impulses threading the ferromagnetic core causes a pulse magnetic field to circulate through the magnetic core. The windings of L1 around its core respond to the changing magnetic field, producing a DC voltage on C1 due to the rectifier D1. Resistor R1 allows for capacitor C1 to discharge to ground when C1 and R1 are shunted by high impedance positive (+) input of the amplifier A1.

A DC voltage at the negative (−) terminals of amplifer comparator A1 is set by the battery supply voltage BAT+, resistor R2 and resistor R3. The output of A1 latches high for as long as the source of ignition continues to replenish the charge on C1 such that the voltage input to the positive (+) terminal of A1 is greater than the voltage at the negative (−) terminal of A1, otherwise the ouput of A1 is low.

The time delay elements C2, R4 and R5 enable the output of amplifier comparator A2 to remain low for a predetermined time after the ignition sensor (output of A1) goes high. Resistor R5 aids the discharge of C2 to ground when ignition sensor goes low. A DC voltage at the negative (−) terminal of amplifer comparator A2 is set by the battery supply voltage BAT+, resistor R6 and resistor R7. The output of A2 latches high for as long as the output of A1 continues to replenish the charge on C2 such that the voltage input to the positive (+) terminal of A2 is greater than the voltage at the negative (−) terminal of A2, otherwise the output of A2 is low.

The output of A2 drives a transistor buffer Q1 through a current limiting resistor R8 which activates the relay switch S1. The normally closed contacts of relay S1 serve the purpose to actuate and open circuit the control element of solenoid switch which operates the starting motor.

Because of the time delay of about 2 seconds between operation of the ignition system and disabling of the starting motor, the engine has ample time for which to start before the starting motor is turned off. A further advantage is the starting motor can not be operated in a continuous manner when the ignition system is working properly.

What I claim as new and desire to protect by Letters Patent of the United States is:

1. An apparatus for automatically preventing a starting motor of a vehicle engine from operating after the engine is running, said engine having an ignition system with at least one ignition coil secondary wire, said apparatus comprising an electrical circuit including:

sensor means inductively coupled to an ignition coil secondary wire;

means for converting impulse signals from said sensor means to provide a DC signal indicating an engine running condition;

time delay means for delaying said DC signal for a predetermined time; and actuating means responsive to the delayed DC signal for disabling operation of said starting motor.

2. The apparatus according to claim 1, wherein said time delay means delays disabling of the starting motor for a predetermined time after the engine has started running.

3. The apparatus according to claim 1, wherein said time delay means causes the starting motor to remain disabled for a predetermined time after the engine has stopped running.

4. The apparatus according to claim 1, wherein said means for converting includes means for rectifying said impulse signals.

5. The apparatus according to claim 1, wherein said actuating means includes for interrupting a control circuit for the starting motor.

* * * * *